US007258072B2

(12) United States Patent
Wong et al.

(10) Patent No.: US 7,258,072 B2
(45) Date of Patent: Aug. 21, 2007

(54) MULTIPLE STEER BY WIRE HELM SYSTEM

(75) Inventors: Ray Tat-Lung Wong, Richmond (CA); Eric B. Fetchko, Burnaby (CA)

(73) Assignee: Teleflex Canada Incorporated, Richmond (CA)

( * ) Notice: Subject to any disclaimer, the term of this patent is extended or adjusted under 35 U.S.C. 154(b) by 0 days.

(21) Appl. No.: 11/236,568

(22) Filed: Sep. 28, 2005

(65) Prior Publication Data

US 2006/0042532 A1 Mar. 2, 2006

Related U.S. Application Data

(63) Continuation-in-part of application No. 10/926,327, filed on Aug. 26, 2004, now Pat. No. 7,137,347.

(51) Int. Cl.
*B63H 25/02* (2006.01)

(52) U.S. Cl. ..... 114/146; 114/144 RE

(58) Field of Classification Search ..... 144/144 R, 144/144 RE, 144 E, 146; 180/321, 322
See application file for complete search history.

(56) References Cited

U.S. PATENT DOCUMENTS

| | | | | |
|---|---|---|---|---|
| 3,695,205 | A | 10/1972 | Thomas | |
| 3,949,696 | A | 4/1976 | Onishi | |
| 4,120,258 | A | 10/1978 | Spurgin | |
| 5,107,424 | A | 4/1992 | Bird et al. | |
| 5,253,604 | A * | 10/1993 | Bohlin | 114/144 E |
| 6,250,418 | B1 | 6/2001 | Matsuoka | |
| 6,273,771 | B1 | 8/2001 | Buckley et al. | |
| 6,311,634 | B1 | 11/2001 | Ford et al. | |
| 6,382,122 | B1 * | 5/2002 | Gaynor et al. | 114/144 RE |
| 6,431,928 | B1 | 8/2002 | Aarnivuo | |
| 6,843,195 | B2 | 1/2005 | Watabe | |
| 2003/0033969 | A1 | 2/2003 | Doetsch | |
| 2003/0150366 | A1 * | 8/2003 | Kaufmann et al. | 114/144 RE |
| 2005/0252433 | A1 * | 11/2005 | Gai | 114/144 R |

FOREIGN PATENT DOCUMENTS

| | | |
|---|---|---|
| CA | 2293850 | 6/2000 |
| EP | 1253061 | 10/2002 |
| WO | WO 00/30934 | 6/2000 |
| WO | WO 02/40336 | 5/2002 |
| WO | WO 02/102616 | 12/2002 |
| WO | WO 02/102640 | 12/2002 |

* cited by examiner

*Primary Examiner*—Sherman Basinger
(74) *Attorney, Agent, or Firm*—Cameron IP

(57) ABSTRACT

A steering apparatus for a marine craft or other vehicle having a communication bus and a plurality of helm apparatuses. Each of the helm apparatuses includes a steering device. Additionally, each of the helm apparatuses is connected to the communication bus. Each of the helm apparatuses provides helm signals indicative of incremental and decremental movement, of the steering device thereof. The helm signals are transmitted over the communication bus. The steering apparatus further includes a rudder which has an actuator and a control means for receiving each of the helm signals and which provides rudder signals to the actuator to steer the rudder in accordance with movement of the steering devices of the helm apparatuses. The control means is connected to the communication bus. Each of the rudder signals are derived from each of the helm signals from one of the helm apparatuses which is steered fastest when a plurality of the helm apparatuses is simultaneously steered.

25 Claims, 6 Drawing Sheets

MULTIPLE STEER BY WIRE HELM SYSTEM

CROSS-REFERENCE TO RELATED APPLICATION

This application is a continuation-in-part of U.S. application Ser. No. 10/926,327, filed on Aug. 26, 2004 now U.S. Pat. No. 7,137,347 and entitled STEER BY WIRE HELM, the disclosure of which is hereby incorporated by reference.

BACKGROUND OF THE INVENTION

This invention relates to helm steering systems and, in particular, to multiple helm steer-by-wire steering systems for marine craft or other vehicles.

Conventional marine steering systems couple one or more helms to one or more rudders utilizing mechanical or hydraulic means. In smaller marine craft, cables conventionally have been used to operatively connect a helm to the rudder. Alternatively the helm has been provided with a manual hydraulic pump operated by rotation of the steering wheel. Hydraulic lines connect the helm pump to a hydraulic actuator connected to the rudder. Some marine steering systems provide a power assist via an engine driven hydraulic pump, similar to the hydraulic power steering systems found in automobiles. In those systems a cable helm or a hydraulic helm mechanically controls the valve of a hydraulic assist cylinder.

It has been recognized that so-called steer-by-wire steering systems potentially offer significant advantages for marine applications. Such systems may yield reduced costs, potentially more reliable operation, more responsive steering, greater tailored steering comfort, and simplified installation. Smart helms allow an original equipment manufacturer (OEM) to tailor steering feel and response to craft type and operator demographics. Steer-by-wire steering systems are also better adapted for modern marine craft fitted with CAN buses or similar communications buses and may make use of electrical information from speed, load and navigation, autopilot or anti-theft devices for example.

Various attempts have been made to provide a commercially viable steer-by-wire steering system for marine craft. An example is found in U.S. Pat. No. 6,273,771 to Buckley et al. which utilizes a CAN bus for a plurality of helms. Another is found in U.S. Pat. No. 5,107,424 to Bird et al. A further example is found in U.S. Pat. No. 6,311,634 to Ford et al.

However these earlier systems have not been completely successful in replacing more conventional hydraulic steering systems in multiple helm marine craft for example. Accordingly there is a need for an improved steer-by-wire steering system particularly adapted for multiple helm marine craft and also potentially useful for other steering applications such as tractors, forklifts and automobiles.

SUMMARY OF THE INVENTION

According to a first aspect of the invention, there is provided a steering apparatus for a marine craft. The steering apparatus comprises two or more helm apparatuses. Each of the helm apparatuses has a steering device. The helm apparatuses provide helm signals indicative of the incremental and decremental movement of the respective steering device. The helm apparatuses are used to steer a steering element which is connected to a steering element actuator. The steering element actuator moves the steering element under control from a steering control means. The steering control means is responsive to the helm signals of each of the helm apparatuses and provides steering signals to the steering element actuator to steer the steering element in accordance with movement of the steering devices of the helm apparatuses.

According to a second aspect of the invention, there is provided a steering apparatus for a marine craft. The steering apparatus comprises two or more helm apparatuses. Each of the helm apparatuses has a steering device. The helm apparatuses provide helm signals indicative of the incremental and decremental movement of the respective steering device. The helm apparatuses are used to steer a steering element which is connected to a steering element actuator. The steering element actuator moves the steering element under control from a steering control means. The steering control means is responsive to the helm signals of each of the helm apparatuses and provides steering signals to the steering element actuator to steer the steering element in accordance with movement of the steering devices of the helm apparatuses. The steering signals are derived from aggregating the helm signals of each of the helm apparatuses.

According to a third aspect of the invention, there is provided a steering apparatus for a marine craft. The steering apparatus comprises two or more helm apparatuses. Each of the helm apparatuses has a steering device. The helm apparatuses provide helm signals indicative of the incremental and decremental movement of the respective steering device. The helm apparatuses are used to steer a steering element which is connected to a steering element actuator. The steering element actuator moves the steering element under control from a steering control means. The steering control means is responsive to the helm signals of each of the helm apparatuses and provides steering signals to the steering element actuator to steer the steering element in accordance with movement of the steering devices of the helm apparatuses. The steering signals are derived from the helm signals from one of the helm apparatuses which is steered fastest when a plurality of the helm apparatuses are simultaneously steered.

According to a fourth aspect of the invention, there is provided a method of steering a marine craft that has a plurality of helms and a steering element, and each of the helms has a steering device. The method comprises the steps of generating helm signals from the steering devices. The helm signals are indicative of the incremental and decremental movement of the steering devices. Steering signals are generated that are derived from the helm signals. The steering element is actuated with the steering signals to effect steering of the marine craft.

The present invention has the advantage of simplifying helm design. All helms in a vessel can be physically identical. That is, no master helm is necessary, nor is a special master setup routine required to configure the master helm. This simplifies manufacturing and the ordering process for the helm manufacturer and marine craft builders.

Taking control of the marine craft is advantageously intuitive and quick with the present invention. The user can grab the wheel of any helm and start steering, without having to login or go through a transfer control routine as with prior art multiple helm systems. This improves the safety and convenience of operating the marine craft or vessel.

The aspect of the present invention wherein the fastest steered helm controls the steering of the marine craft over other helms has many advantages. The faster win scenario signifies that emergency movement is most likely with a higher rate of turn of the steering wheel. Additionally, adults tend to turn boats faster than children. The faster win scenario also advantageously ignores minor, unintentional movement from inactive helms, typically due to vibration or wind.

BRIEF DESCRIPTION OF THE DRAWINGS

The present invention will be more readily understood from the following description of preferred embodiments thereof given, by way of example, with reference to the accompanying drawings, in which.

DETAILED DESCRIPTIONS OF THE PREFERRED EMBODIMENTS

Figure 1:
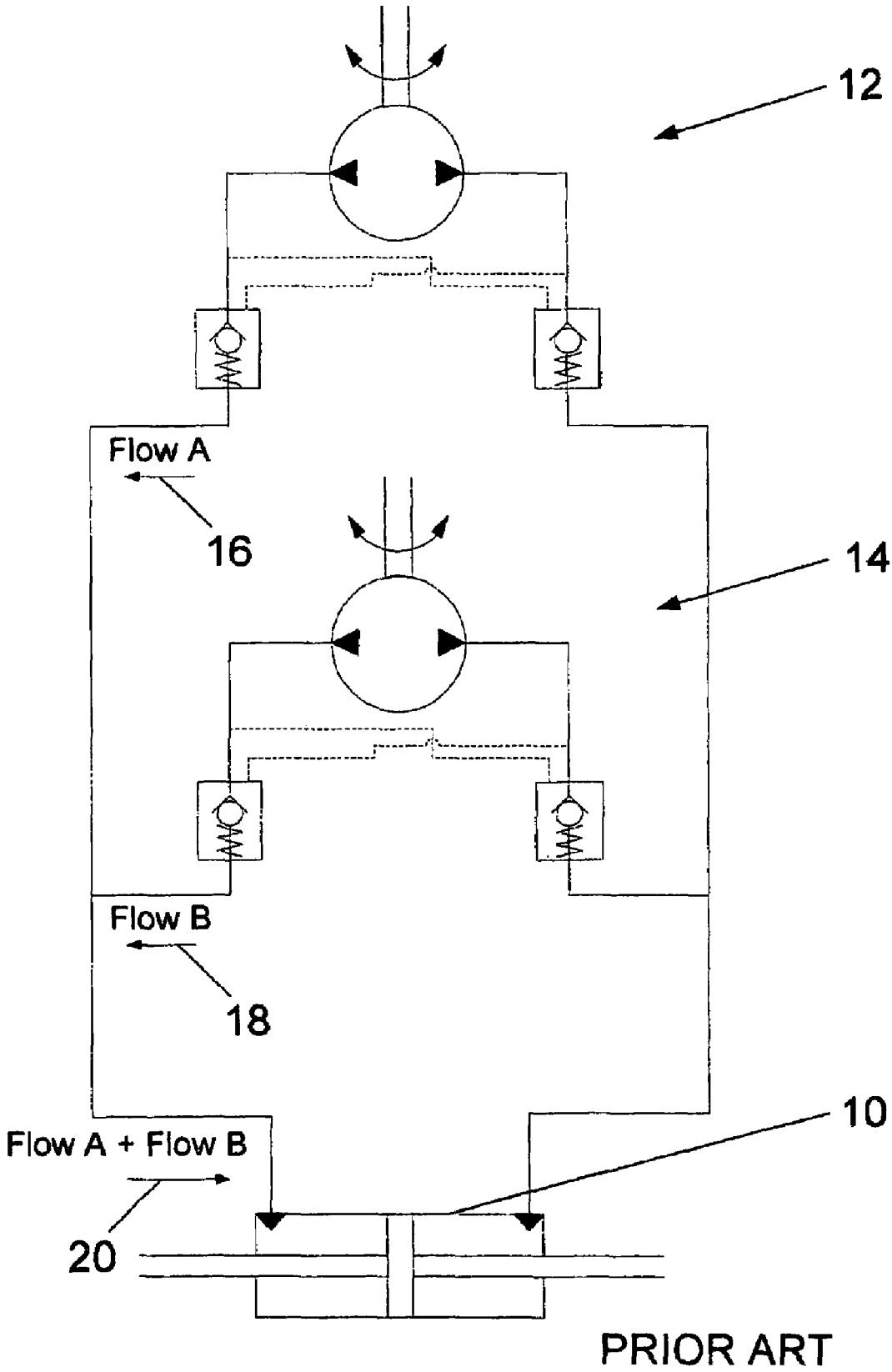
FIG. 1 is a schematic view of a conventional hydraulic marine steering apparatus having multiple helms.

With reference to FIG. 1, a conventional marine steering system having multiple helms includes a hydraulic cylinder 10, a first hydraulic helm and a second hydraulic helm indicated generally by reference characters 12 and 14 respectively. The hydraulic cylinder 10 operates to actuate a rudder to steer the marine vessel. The fist hydraulic helm 12 is connected in parallel to the second hydraulic helm 14.

When a first vessel operator steers the first hydraulic helm 12, a flow 16 of hydraulic fluid is produced. When a second operator simultaneously steers the second hydraulic helm 14, a flow 18 is produced. A hydraulic cylinder flow 20 equals the sum of the flow 16 and the flow 18.

If the first operator turns faster than the second operator, the flow 16 is then greater than the flow 18 and dominates the flow 20 of the hydraulic cylinder 10.

This is the basic operation of a conventional multiple helm hydraulic marine steering system. One embodiment of the present invention provides an equivalent multiple helm functionality in a novel way in a steer-by-wire marine steering system, as described below.

Figure 2:
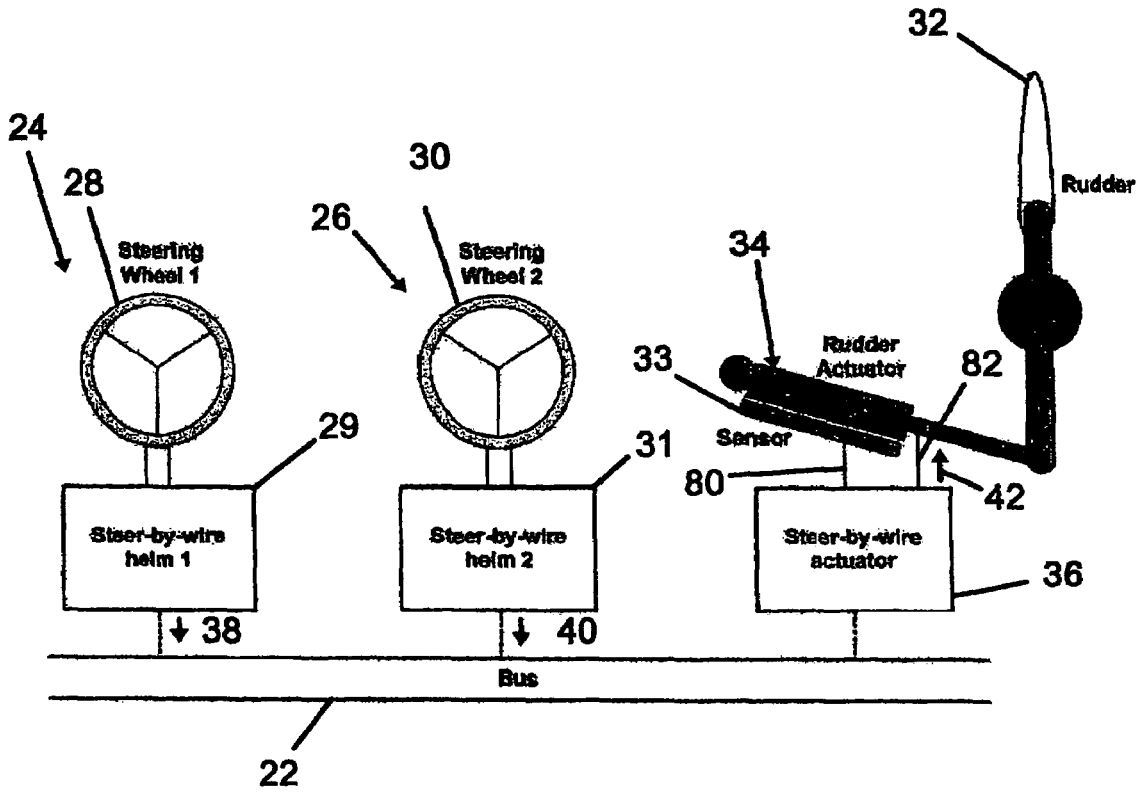
FIG. 2 is a simplified block diagram of a hydraulic marine steering apparatus according to one embodiment of the present invention.

Now referring to FIG. 2, in a first embodiment of the present invention there is a communication bus 22, which in this example is a Local Interconnect Network (LIN) bus. In other embodiments the communication bus 22 can be other types of communication buses, either wired or wireless, such as CAN, $I^2C$, SPI, USB, RS232, Ethernet, wireless Ethernet, Bluetooth and Zigabee. The communication bus 22 is used as a communication backbone for other elements in the multiple helm steer-by-wire steering system as will be shown below.

In the present embodiment, steer-by-wire helms, indicated generally by reference numerals 24 and 26, are connected to the communication bus 22. In other embodiments any other number of steer-by-wire helms can be connected to the communication bus. The steer-by-wire helms 24 and 26 include steering wheels 28 and 30 respectively in this example, and helm controllers 29 and 31 respectively. As understood by one skilled in the art, other types of steering devices can be used in other examples.

A steering element, in this example a rudder 32, is connected to a rudder actuator 34. In alternative embodiments the rudder could be replaced by other steering means such as an inboard/outboard drive or an outboard motor. The rudder 32 operates to change the direction of the marine vessel and the rudder actuator 34 changes the orientation of the rudder with respect to the marine vessel. The rudder actuator 34 is connected to a rudder actuator controller 36 for controlling the rudder actuator. The rudder actuator 34 comprises a sensor 33 that provides positional information about the rudder actuator. The rudder actuator controller 36 is connected to the communication bus 22.

Figure 3:
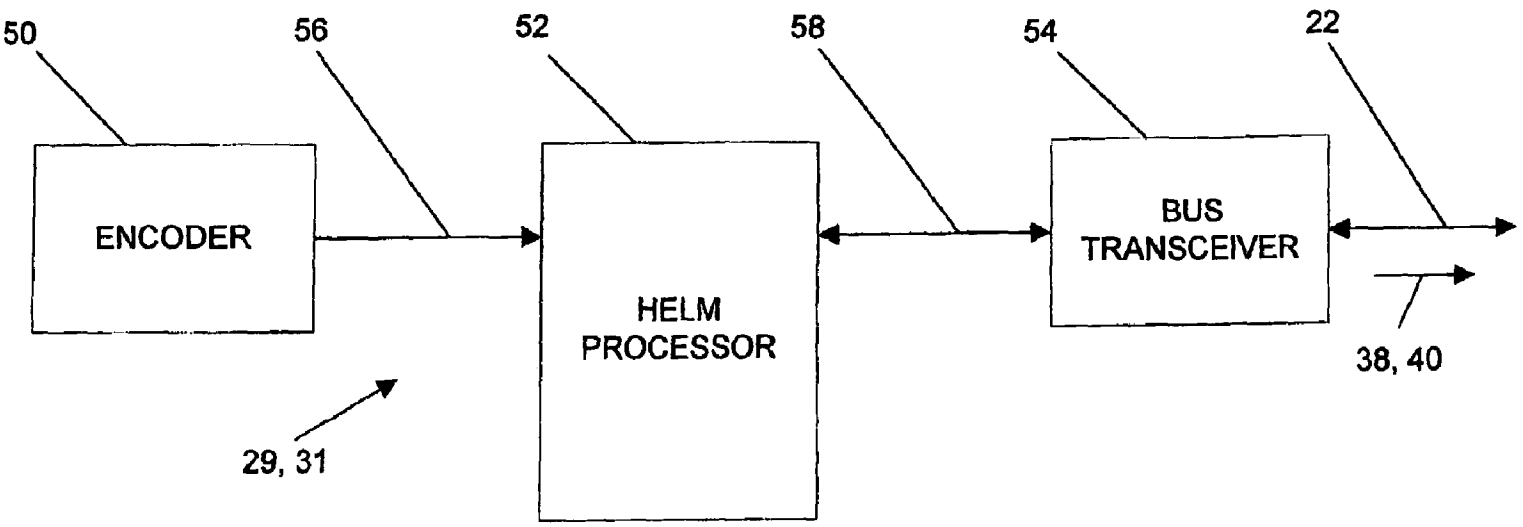
FIG. 3 is a simplified block diagram of a helm apparatus of the embodiment of FIG. 2.

Referring now to FIG. 3, each of the helm controllers 29 and 31 includes an encoder 50, a helm processor 52 and a bus transceiver 54. The encoder is connected to the helm processor 52 by connection 56. The helm processor 52 is connected to the bus transceiver by connection 58. In this example the connections 56 and 58 are electrical connections, but other types of connections are possible, such as wireless connections, and these are intended to be within the scope of the present invention.

Each of the encoders 50 is responsive to its respective steering wheel 28 and 30 and, in this example, provides helm signals in the form of quadrature signals to the helm processor over connection 56. The helm signals are representative of the increment or decrement in the movement of steering wheels 28 and 30. It is to be understood that the helm signals are logical signals herein and can appear in different forms in different parts of the multiple steer by wire helm system, for example a digital electrical signal or a digital wireless signal.

The helm processor 52 is a microcontroller in this example and comprises a data processing means and a data storage means. The helm processor 52 stores and executes software instructions of a control program. In other embodiments the helm processor can comprise a microprocessor and a memory. The memory can comprise a non-volatile memory, such as a Read Only Memory (ROM) or an Electrically Eraseable Programmable ROM ($E^2$PROM), and a volatile memory such as a Random Access Memory (RAM) or other types of memory.

It is understood by those skilled in the art that in other examples the helm controllers 29 and 30 can include a programmable logic device or an ASIC instead of the helm processor 52.

The control program of the helm processor 52 includes instructions to receive the helm signals, in the form of quadrature signals in this example, from the encoder 50 and instructions to transmit the helm signals onto the communication bus 22.

As is understood by those familiar with the art, the bus transceiver 54 electrically conditions any signal from the helm processor 52 for transmission onto the communication bus 22. The bus transceiver also conditions signals from the communication bus for reception in the helm processor 52.

Figure 4:
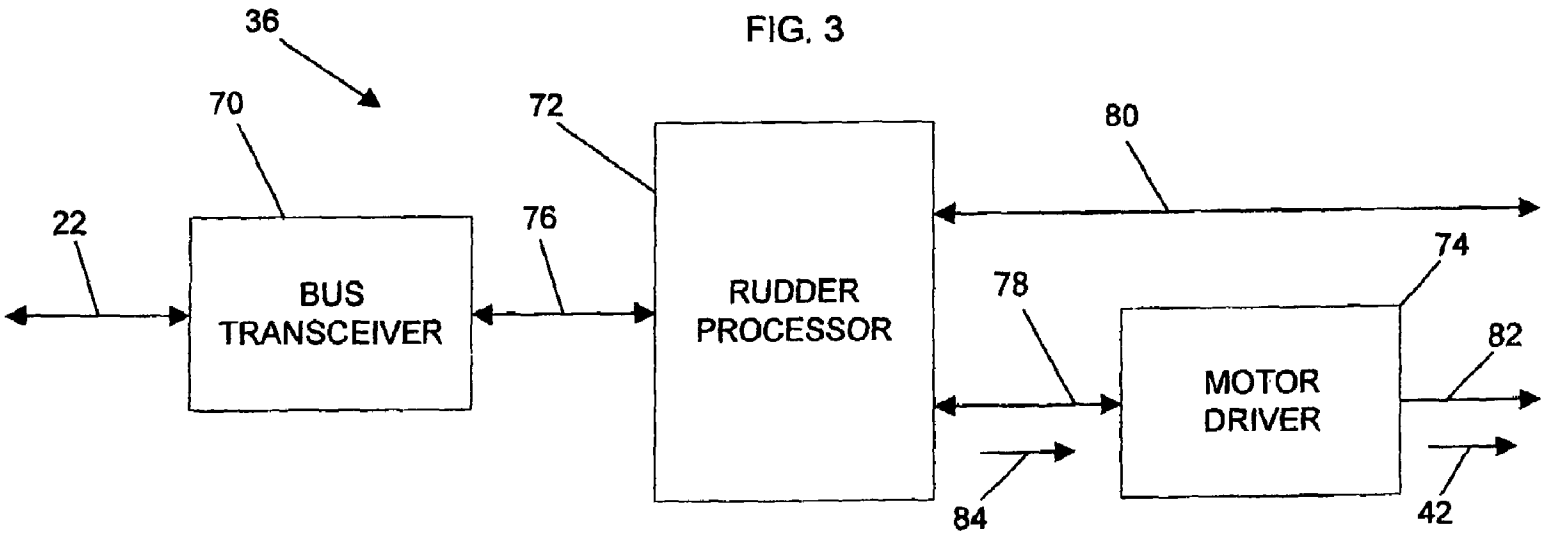
FIG. 4 is a simplified block diagram of a rudder actuator controller of the embodiment of FIG. 2.

Referring now to FIG. 4, the rudder actuator controller 36 includes a bus transceiver 70, a rudder processor 72 and a motor driver 74 for the rudder actuator 34. The bus transceiver is connected to the rudder processor by connection 76. The rudder processor is connected to the motor driver 74 by connection 78 and to the rudder actuator 34 by connection 80. The motor driver is connected to the rudder actuator 34 by connection 82. In this example the connections 76, 78, 80 and 82 are electrical connections, but other types of connections are possible. The motor driver 74 drives the rudder 32 and the sensor 33 provides positional feedback information of the rudder 32 over the connection 80.

The operation of the bus transceiver 70 is similar in principle to the operation of bus transceiver 54 above. The bus transceiver electrically conditions signals from the communication bus 22 and from the rudder processor 72.

The helm processor 72 is a microcontroller in this example and comprises a data processing means and a data storage means. The helm processor 72 stores and executes software instructions of a control program. In other embodiments the helm processor can comprise a microprocessor and a memory. The memory can comprise a non-volatile memory, such as a Read Only Memory (ROM) or an Electrically Eraseable Programmable ROM ($E^2$PROM), and a volatile memory such as a Random Access Memory (RAM) or other types of memory.

It is understood by those skilled in the art that in other examples the rudder actuator controller 36 can include a programmable logic device or an ASIC instead of the helm processor 72.

The control program of the rudder processor 72 includes instructions to receive signals from the communication bus 22 via bus transceiver 70 and instructions to generate rudder signals in the form of motor driver signals indicated generally by reference numeral 84. The rudder signals are logical signals and are used to actuate the rudder actuator 34.

The motor driver 74 electrically conditions the rudder signals in the form of motor driver signals 84 from the rudder processor 72 into rudder signals for the rudder actuator 34, as indicated by reference numeral 42 in FIGS. 2 and 4. It is to be understood that the rudder signals are logical signals herein and can appear in different forms in different parts of the multiple steer by wire helm system.

Referring again to FIG. 2, in operation the rudder 32 has a default position in which it allows the marine vessel to continue in its current direction. The steering wheels 28 and 30 have default positions corresponding to the default position of the rudder 32. A clockwise or counterclockwise movement of either of the steering wheels 28 and 30 away from their default positions is considered a steering increment, whereas a movement towards their default positions is considered a steering decrement.

The steer-by-wire helms 24 and 26 do not require information on the absolute position of the rudder 32. The helms 24 and 26 merely provide incremental indications of movement of the steering wheels 28 and 30, and respond to steering resistance signals from the controller 36 in order to provide rotational resistance to the steering wheels to effect steering feedback resistance. The steering resistance signals from the controller 36 are related to the position of the rudder 32.

The sensor 33 provides positional information of the rudder 32 to the rudder actuator controller 36. The rudder actuator controller 36 sends the steering resistance signals to the helms 24 and 26 over the communication bus 22 for controlling the steering feedback resistance applied to the steering wheels 28 and 30 respectively. The steering feedback resistance is experienced by a person manipulating the steering wheel as resistance in turning the wheel, in a certain direction. As the rudder 32 approaches a maximum steered position, the steering feedback resistance applied to the steering wheel is experienced by the person as increased resistance in the direction of steering. When the rudder 32 reaches the maximum steered position, the steering feedback resistance applied to the steering wheel prevents the person from steering the wheel further in that direction of steering.

Figure 8:
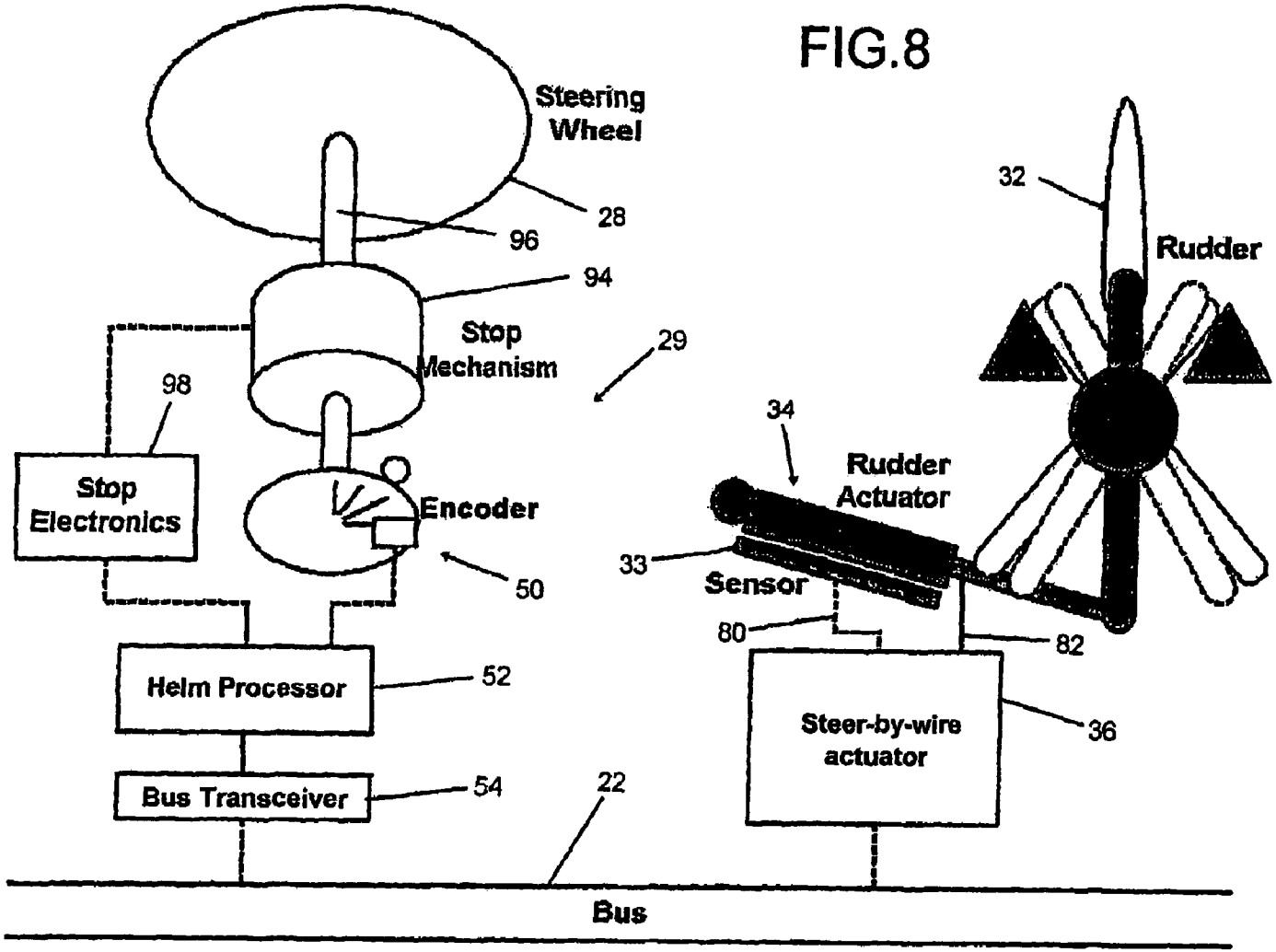
FIG. 8 is simplified block diagram of a hydraulic marine steering apparatus of the embodiment of FIG. 2 with a stop mechanism.

Referring to FIG. 8, the helm controller 29 also has a brake in the form of a stop mechanism 94, a drive shaft 96 and stop electronics 98, the helm controller 31 having corresponding elements. The stop mechanism 94 is similar to the stop mechanism described in U.S. patent application Ser. No. 10/926,327, which is incorporated herein by reference, and includes in this example a multi-plate clutch having a plurality of clutch plates, and an actuator in the form of a solenoid with an armature. The armature is provided with a shaft which is press fitted to connect the armature to the inside of a drum of the drive shaft 94. Accordingly, the armature is rigidly connected to the drive shaft 94.

When the rudder 32 reaches the maximum steered position, i.e. a starboard or port hard-over position, the helm processor 52 receives steering resistance signals from the communication bus 22 and accordingly applies a stop signal to the stop mechanism 94 through the stop electronics 98. The stop signal actuates the solenoid to force the plates together causing friction between the plates thereby stopping rotation of the drive shaft 96. There is some play between the steering device 28 and the drive shaft 96, and since the encoder 50 detects movement of the steering device 28, the helm processor 52 can detect movement of the steering device away from the maximum steered position so that it can release the stop mechanism enabling the drive shaft to rotate away from the maximum steered position as well thereby providing steering decrement signals.

Another aspect of the present invention is instantaneous synchronization of steering wheels 28 and 30. As an example, if the steering wheel 28 is one quarter turn, i.e. 90 degrees, from end stop, and a person turns it one eighth of a full rotation towards end stop, then the wheel has one eighth of a turn remaining before reaching an end stop. The end stop occurs when the steering feedback resistance applied to the wheel prevents the wheel from turning in a certain direction, and which corresponds to a maximum steered position of the rudder 32. Now, if that person next goes to the steering wheel 30 and begins to turn it in the same direction in which the steering wheel 28 was turned, then wheel 30 can turn at most one eighth of a turn before reaching the end stop. This is possible since the rudder actuator controller 36 is aware of the absolute rudder position due to the sensor 33, and therefore the controller 36 can inform the helms 24 and 26 accordingly.

The steer-by-wire helms 24 and 26 and the rudder actuator controller 36 can operate in an accumulated steering manner. Referring back to FIG. 2, a first operator steers the steering wheel 28 which causes the steer-by-wire helm 24 to generate a helm signal 38 representative of the increment or decrement in the steering wheel. The helm signal 38 is directed onto the communication bus 22. Whenever the first operator changes the position of the steering wheel 28 the helm signal 38 is generated and is directed onto the communication bus 22.

Similarly, a second operator steers the steering wheel 30 which causes the steer-by-wire helm 26 to generate helm signal 40 which is correspondingly directed onto the communication bus 22.

The helm signals 38 and 40 are signed signals representative of an increment in steering, in which case they are positive in this example, or a decrement in steering, in which case they are negative in this example.

The helm signals 38 and 40 are received by the rudder actuator controller 36 whenever they are directed onto the communication bus 22. The control program of the rudder processor 72 includes instructions to provide an aggregate signal equal to the accumulation of the helm signals 38 and 40. The rudder actuator controller 36 continuously receives the helm signals 38 and 40 and continuously updates the aggregate signal with the helm signal values.

The control program of the rudder processor 72 periodically generates a rudder signal 42, which is equivalent to the sum of the aggregate helm signal and a previous rudder signal. The rudder signal 42 is applied to the rudder actuator 34 to actuate the rudder 32. After the rudder signal 42 is generated, the aggregate signal is reset to a zero value and the previous rudder signal is equated to the rudder signal. A mathematical expression for the rudder signal 42 is symbolically stated as:

$$\theta_{new}=\theta_{previous}+\Sigma\Delta\theta_{38}+\Sigma\Delta\theta_{40}$$

wherein $\theta_{new}$ is the rudder signal, $\theta_{previous}$ is the previous rudder signal, $\Delta\theta_{38}$ is the helm signal 38, $\Delta\theta_{40}$ is the helm signal 40 and $\Sigma\Delta\theta_{38}+\Sigma\Delta\theta_{40}$ is the aggregate signal.

This embodiment simulates the operation of the conventional multiple helm hydraulic marine steering system using steer-by-wire helms 24 and 26. If the first operator steers more frequently than the second operator then there will be more helm signals 38 from the steer-by-wire helm 24 than helm signals 40 from the steer-by-wire helm 26. Accordingly, the aggregate signal will be dominated by the helm signal 38, and so will the rudder signal 42. If the first operator steers faster than the second operator then the helm signals 38 from the steer-by-wire helm 24 will be greater in absolute value than the absolute value of helm signals 40 from the steer-by-wire helm 26. Accordingly, the aggregate signal, again, will be dominated by the helm signal 38, and so will the rudder signal 42.

The communication bus 22 makes it easier to add additional helms in the marine steering system. In general, the rudder signal 42 is defined as $$\theta_{new}=\theta_{previous}+\Sigma\Delta\theta_i$$

wherein $\Delta\theta_i$ is a helm signal and where "i" is an index for the helms.

One concern about accumulating the helm signals 38 and 40 is that the rudder signal 42 may direct the rudder actuator 34 to steer too quickly. This concern may be solved by limiting the maximum rate of steering by the control program in the rudder actuator controller 36 or, alternatively, by the size of the rudder actuator 34.

This accumulating steering arrangement has the advantage of simplifying helm design. All helms can be physically identical. That is, no master helm is necessary, nor is a special master setup routine to configure the master helm. This simplifies manufacturing and the ordering process for the helm manufacturer and marine vessel builders.

Taking control of the marine vessel is advantageously intuitive and quick in this embodiment. The user can grab the wheel of either helm and start steering, without having to login or go through a transfer control routine as with prior art multiple helm systems. This improves the safety of operating the marine vessel.

Alternatively, a variation of the accumulating steering is a "faster win" scenario. Instead of the control program of the rudder processor 72 aggregating all helm signals from the multiple helms, the control program of the rudder processor 72 uses the helm signal with the largest amplitude, the other helm signals being discarded. In this situation, the user who steers the wheel the fastest has control of the boat.

A mathematical expression for the rudder signal 42 in the faster win scenario is symbolically stated as:

$$\theta_{new}=\theta_{previous}+\max(\Delta\theta_{38}+\Delta\theta_{40})$$

wherein $\theta_{new}$ is the rudder signal, $\theta_{previous}$ is the previous rudder signal, $\Delta\theta_{38}$ is the helm signal 38, $\Delta\theta_{40}$ is the helm signal 40 and $\max(\Delta\theta_{38}+\Delta\theta_{40})$ is the fastest helm signal.

The faster win scenario signifies that emergency movement is most likely with a higher rate of turn of the steering wheel. Additionally, adults tend to turn boats faster than children. The faster win scenario also advantageously ignores minor, unintentional movement from inactive helms, typically due to vibration or wind.

An optional collision acknowledgement indication can be used with either the accumulating steering or faster win steering scenarios, warning users that multiple helms are attempting to steer the boat. This promotes a dialog among the helmsman to coordinate steering control of the boat.

Figure 5:
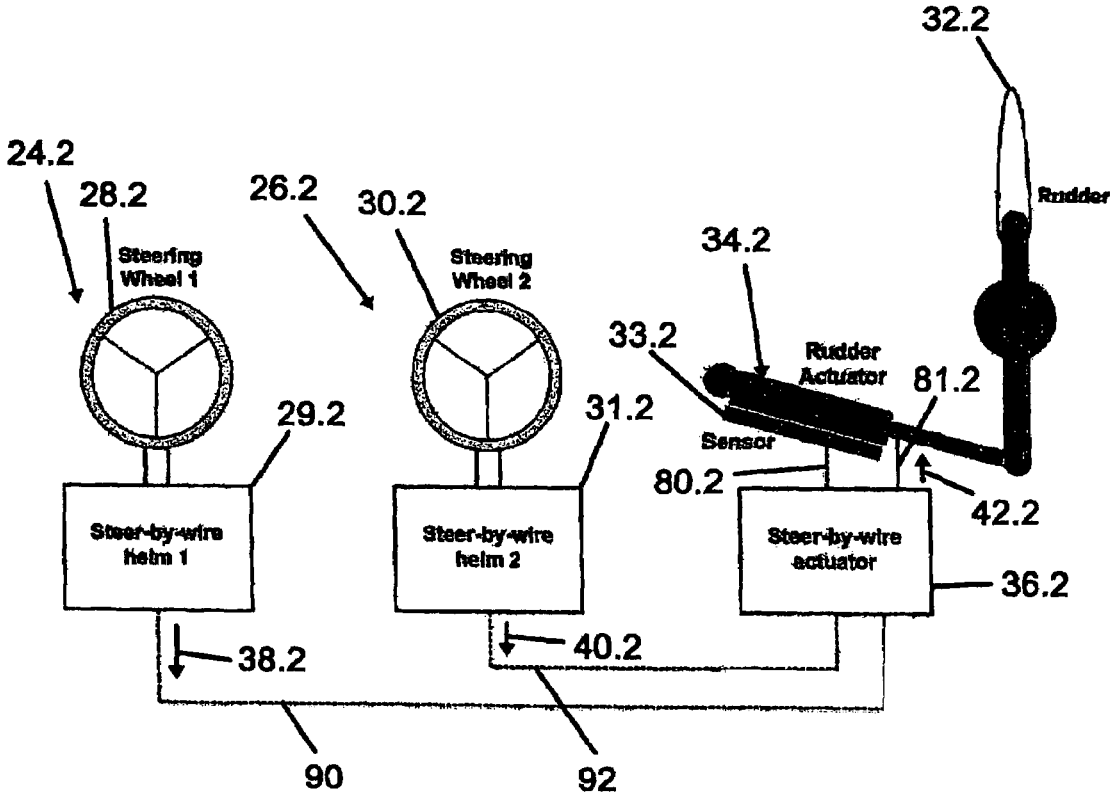
FIG. 5 is a simplified block diagram of another hydraulic marine steering apparatus according to another embodiment of the present invention.

Referring now to FIG. 5, another embodiment of the present invention, wherein like parts to the previous embodiment have like reference numerals with an additional suffix ".2", includes helm apparatuses indicated generally by reference numeral 24.2 and 26.2. In other examples there can be any number of helm apparatuses. There is also a rudder 32.2, a rudder actuator 34.2 and a rudder actuator controller 36.2 for controlling the rudder actuator. As in the previous embodiment the apparatus may be used with other types of steering elements besides rudders.

The helm apparatus 24.2 is directly connected to the rudder actuator controller 36.2 by electrical connection 90. The helm apparatus 24.2 includes a steering device 28.2 and a helm controller 29.2.

The helm apparatus 26.2 is directly connected to the rudder actuator controller 36.2 by electrical connection 92. The helm apparatus 26.2 includes a steering device 30.2 and a helm controller 31.2.

Figure 6:
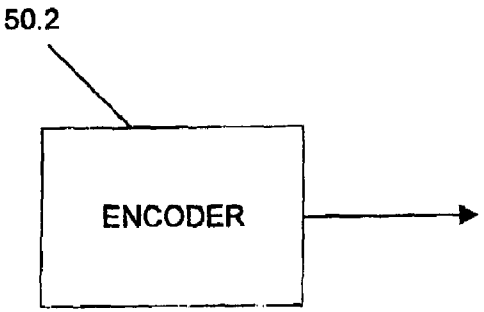
FIG. 6 is a simplified block diagram of a helm apparatus of the embodiment of FIG. 5.

Referring now to FIG. 6, each of the helm controllers 29.2 and 31.2 includes an encoder 50.2. Each encoder 50.2 is connected directly to the rudder actuator controller 36.2. Each encoder 50.2 is responsive to one of the steering devices 28.2 and 30.2 and provides helm signals in the form of quadrature signals.

Figure 7:
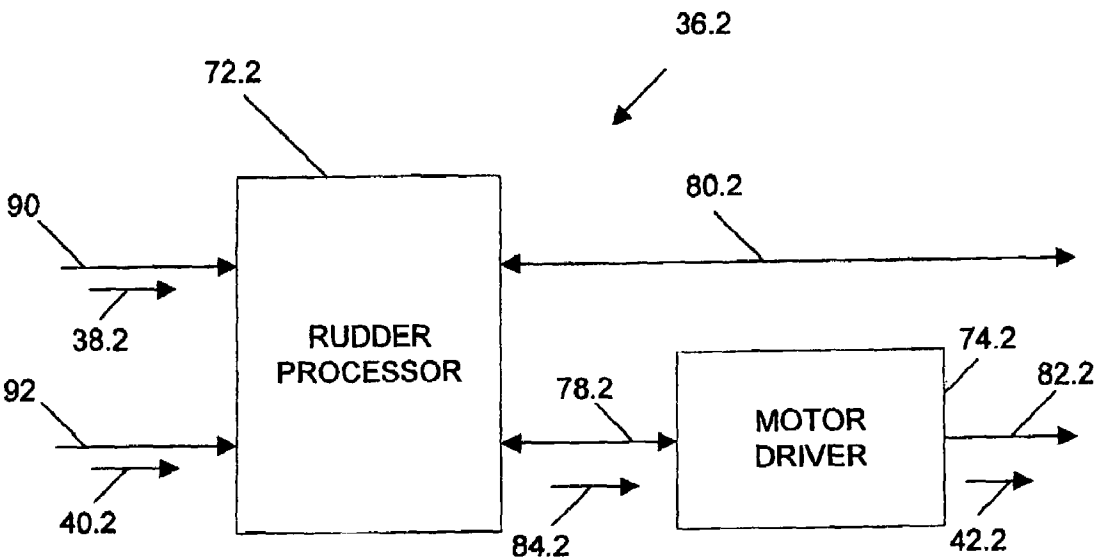
FIG. 7 is a simplified block diagram of a rudder actuator controller of the embodiment of FIG. 5.

Referring now to FIG. 7, the rudder actuator controller 36.2 includes a rudder processor 72.2 and a motor driver 74.2 for the rudder actuator 34.2. The rudder processor 72.2 is a microcontroller, in this example, and comprises a data processing means and a data storage means. The rudder processor 72.2 is connected to electrical connections 90 and 92.

The helm processor 72.2 stores and executes software instructions of a control program. In other embodiments the helm processor 72.2 can comprise a microprocessor and a memory. The memory can comprise a non-volatile memory, such as a Read Only Memory (ROM) or an Electrically Eraseable Programmable ROM ($E^2$PROM), and a volatile memory such as a Random Access Memory (RAM).

It is understood by those skilled in the art that in other examples the rudder actuator controller 36.2 can include a programmable logic device or an ASIC instead of the rudder processor 72.2.

The control program of the rudder processor 72.2 includes instructions to receive the helm signals, in the form of quadrature signals in this example, from connections 90 and 92 and instructions to generate rudder signals in the form of motor driver signals indicated generally by reference numeral 84.2. The motor driver 74 electrically conditions the motor driver signals 84.2 from the rudder processor 72.2 into rudder signals 42.2 for the rudder actuator 34.

This embodiment operates in a similar manner to the previous embodiments, i.e. with aggregate steering or faster win steering, therefore the operation will not be explained again.

This embodiment has the advantage of being more cost effective since the connections 90 and 92 are less complex than the communication bus 22 of the previous embodiment. However, the previous embodiment has the advantage of being more robust, less coupled and more functionality, i.e. control signals can go between the helms and the rudder actuator controller 36, and between the rudder actuator controller and each of the helms.

It will be understood by someone skilled in the art that many of the details provided above are by way of example only and are not intended to limit the scope of the invention which is to be interpreted with reference to the following claims.

What is claimed is:

1. A steering apparatus for a marine craft, the steering apparatus comprising:

a plurality of helm apparatuses, each said helm apparatus including a steering device, each said helm apparatus providing helm signals indicative of incremental and decremental movement of the steering device thereof;

a steering element;

a steering element actuator; and a control means for controlling the steering element actuator, the control means receiving the helm signals from two said helm apparatuses when said two helm apparatuses are steered simultaneously, the control means being responsive to said helm signals of each of the helm apparatuses and providing steering signals to the steering element actuator to steer the steering element in accordance with movement of the steering devices of the helm apparatuses.

2. The steering apparatus as claimed in claim 1, wherein the steering element is a rudder, the steering element actuator is a rudder actuator and the steering signals are rudder signals.

3. The steering apparatus as claimed in claim 2, wherein said rudder signals are derived from aggregating said helm signals of each of the helm apparatuses.

4. The steering apparatus as claimed in claim 1, wherein the apparatus further includes a communication bus, the control means and each of the helm apparatuses being coupled to the communication bus, each of the helm apparatuses transmitting respective helm signals onto the communication bus and the control means receiving the helm signals from the communication bus.

5. The steering apparatus of claim 4, wherein each said helm apparatus further includes:

an encoder responsive to the steering device and providing the helm signals;

at least one of a data processing means, a data storage means, a programmable logic device and an application specific integrated circuit; and a means for receiving the helm signals from the encoder and transmitting said helm signals onto the communication bus.

6. The steering apparatus of claim 4, wherein the communication bus is at least one of a wired bus and a wireless bus.

7. The steering apparatus of claim 4, wherein the communication bus is at least one of a Local Interconnect Network (LIN) bus, a Controller Area Network (CAN) bus and an Ethernet bus.

8. The steering apparatus as claimed in claim 1, wherein the control means includes at least one of a data processing means, a data storage means a programmable logic device and an application specific integrated circuit.

9. The steering apparatus as claimed in claim 8, wherein the control means further includes a means for deriving said steering signals from aggregating said helm signals of each of the helm apparatuses.

10. The steering apparatus of claim 1, wherein the steering device is a steering wheel.

11. The steering apparatus of claim 1, wherein each of the helm apparatuses further includes an encoder, the encoder being responsive to the steering device and providing the helm signals.

12. The steering apparatus as claimed in claim 1, wherein each of the helm apparatuses are connected to the control means.

13. The steering apparatus as claimed in claim 1, wherein the apparatus further includes a sensor for detecting the position of the steering element, said sensor providing position information of the steering element to the control means.

14. A method of steering a marine craft having a plurality of helms, a steering element, and a control means for controlling the steering element, each said helm having a steering device, the method comprising the steps of:

generating helm signals from the steering devices, the helm signals being indicative of the incremental and decremental movement of the steering devices, the control means receiving the helm signals from two said helms when said two helms are steered simultaneously, the control means being responsive to said helm signals;

generating steering signals by the control means that are derived from said helm signals; and actuating the steering element with the steering signals to effect steering of the marine craft.

15. The method of steering as claimed in claim 14, wherein the steering signals are derived from aggregating said helm signals of each of the steering devices.

16. A steering apparatus for a marine craft, the steering apparatus comprising:

a plurality of helm apparatuses, each said helm apparatus including a steering device, each said helm apparatus providing helm signals indicative of incremental and decremental movement of the steering device thereof;

a steering element;

a steering element actuator; and a control means for controlling the steering element actuator, the control means being responsive to said helm signals of each of the helm apparatuses and providing steering signals to the steering element actuator to steer the steering element in accordance with movement of the steering devices of the helm apparatuses, said steering signals being derived from said helm signals from one of said helm apparatuses which is steered fastest when a plurality of said helm apparatuses is simultaneously steered.

17. A steering apparatus for a marine craft, the steering apparatus comprising:

a plurality of helm apparatuses, each said helm apparatus including a steering device, each said helm apparatus providing helm signals indicative of incremental and decremental movement of the steering device thereof;

a steering element;

a steering element actuator; and a control means for controlling the steering element actuator, the control means including at least one of a data processing means, a data storage means, a programmable logic device and an application specific integrated circuit, the control means being responsive to said helm signals of each of the helm apparatuses and providing steering signals to the steering element actuator to steer the steering element in accordance with movement of the steering devices of the helm apparatuses, the control means further including a means for deriving said steering signals from said helm signals from one of said helm apparatuses which is steered fastest when a plurality of said helm apparatuses is simultaneously steered.

18. A steering apparatus for a marine craft, the steering apparatus comprising:

a plurality of helm apparatuses, each said helm apparatus including a collision acknowledgment means for indicating two or more of the plurality of helm apparatuses are attempting to steer the marine craft, each said helm apparatus including a steering device, each said helm apparatus providing helm signals indicative of incremental and decremental movement of the steering device thereof;

a steering element;

a steering element actuator;

a communication bus; and a control means for controlling the steering element actuator, the control means and each of the helm apparatuses being coupled to the communication bus, each of the helm apparatuses transmitting respective helm signals onto the communication bus and the control means receiving the helm signals from the communication bus, the control means being responsive to said helm signals of each of the helm apparatuses and providing steering signals to the steering element actuator to steer the steering element in accordance with movement of the steering devices of the helm apparatuses.

19. The steering apparatus as claimed in claim 18, wherein the control means includes means for controlling the rotational resistance of each of the steering devices.

20. A steering apparatus for a marine craft, the steering apparatus comprising:

a steering element;

a steering element actuator;

a control means for controlling the steering element actuator; and a plurality of helm apparatuses, each said helm apparatus including a steering device, each said helm apparatus providing helm signals indicative of incremental and decremental movement of the steering device thereof, the control means being responsive to said helm signals of each of the helm apparatuses and providing steering signals to the steering element actuator to steer the steering element in accordance with movement of the steering devices of the helm apparatuses, each of the helm apparatuses having a stop mechanism and a sensor, the stop mechanism being actuated when the steering element approaches a limit of travel, causing the stop mechanism to engage the steering device to stop further rotation of the steering device in a first rotational direction, corresponding to rotational movement towards the limit of travel, rotational play being provided between the steering device and the stop mechanism, whereby the steering device can be rotated a limited amount, as sensed by the sensor, when the stop mechanism is fully engaged, the stop mechanism being released from engagement with the steering device when the sensor senses that the steering device is rotated, as permitted by said play, in a second rotational direction which is opposite the first rotational direction.

21. A method of steering a marine craft having a plurality of helms and a steering element, each said helm having a steering device, the method comprising the steps of:

generating helm signals from the steering devices, the helm signals being indicative of the incremental and decremental movement of the steering devices;

generating steering signals that are derived from said helm signals, the steering signals being derived from said helm signals from one of said steering devices which is steered fastest when a plurality of said steering devices is simultaneously steered; and actuating the steering element with the steering signals to effect steering of the marine craft.

22. The method of steering as claimed in claim 21, wherein the method further including the steps of:

generating position signals representative of the position of the steering element;

generating steering resistance signals from the position signals; and providing steering feedback resistance to the steering devices based on the steering resistance signals.

23. A method of steering a marine craft having a plurality of helms and a steering element, each said helm having a steering device, the method comprising the steps of:

generating helm signals from the steering devices, the helm signals being indicative of the incremental and decremental movement of the steering devices;

generating steering signals that are derived from said helm signals;

actuating the steering element with the steering signals to effect steering of the marine craft;

generating position signals representative of the position of the steering element;

generating steering resistance signals from the position signals; and providing steering feedback resistance to the steering devices based on the steering resistance signals and including the step of synchronizing the steering resistance signals with each of the helms.

24. A method of steering a marine craft having a plurality of helms and a steering element, each said helm having a steering device, the method comprising the steps of:

generating helm signals from the steering devices, the helm signals being indicative of the incremental and decremental movement of the steering devices;

generating steering signals that are derived from said helm signals;

actuating the steering element with the steering signals to effect steering of the marine craft;

generating position signals representative of the position of the steering element;

generating steering resistance signals from the position signals;

providing steering feedback resistance to the steering devices based on the steering resistance signals; and synchronizing the steering feedback resistance of each of the steering devices relative the steering resistance signals.

25. The steering apparatus as claimed in claim 1, wherein the control means employs a mathematical algorithm in determining the steering signals from the helm signals.

* * * * *